US006278367B1

(12) United States Patent
Baglin

(10) Patent No.: US 6,278,367 B1
(45) Date of Patent: Aug. 21, 2001

(54) ARTICLE DISPLACEMENT INDICATION

(76) Inventor: Neil Ernest Baglin, 53 Green End, Gamlingay, Sandy SG193JU (GB)

( * ) Notice: Subject to any disclaimer, the term of this patent is extended or adjusted under 35 U.S.C. 154(b) by 0 days.

(21) Appl. No.: 09/463,061

(22) PCT Filed: Jul. 16, 1998

(86) PCT No.: PCT/GB98/02119

§ 371 Date: Mar. 27, 2000

§ 102(e) Date: Mar. 27, 2000

(87) PCT Pub. No.: WO99/04376

PCT Pub. Date: Jan. 28, 1999

(30) Foreign Application Priority Data

Jul. 16, 1997 (GB) ..... 9714855

(51) Int. Cl.[7] ..... G08B 13/08

(52) U.S. Cl. ..... 340/546; 340/693.9; 340/686.1; 340/545.1; 340/548; 340/545.2; 340/545.5; 340/566

(58) Field of Search ..... 340/546, 545.1, 340/548, 545.2, 693.9, 686.1, 545.5, 545.7, 545.8, 550, 566

(56) References Cited

U.S. PATENT DOCUMENTS

| | | | | |
|---|---|---|---|---|
| 3,696,380 | * | 10/1972 | Murphy | 340/546 |
| 4,149,156 | * | 4/1979 | Blasucci | 340/545.2 |
| 4,206,452 | * | 6/1980 | Blasucci | 340/548 |
| 5,489,890 | * | 2/1996 | Moser | 340/546 |
| 5,552,768 | * | 9/1996 | Mikiel et al. | 340/546 |
| 5,734,324 | * | 3/1998 | James | 340/546 |

* cited by examiner

*Primary Examiner*—Benjamin C. Lee
(74) *Attorney, Agent, or Firm*—Brinks Hofer Gilson & Lione

(57) ABSTRACT

A device for indicating/limiting the overall displacement of a movable member from a preset position, wherein the device (1) is selectively positionable to accomodate variation in allowable displacement of the movable member (32, 38, 39, 42, 49, 50, 52) prior to preventing displacement of the movable member or for providing an indication of any such displacement of the member.

17 Claims, 3 Drawing Sheets

ARTICLE DISPLACEMENT INDICATION

Figure 1:
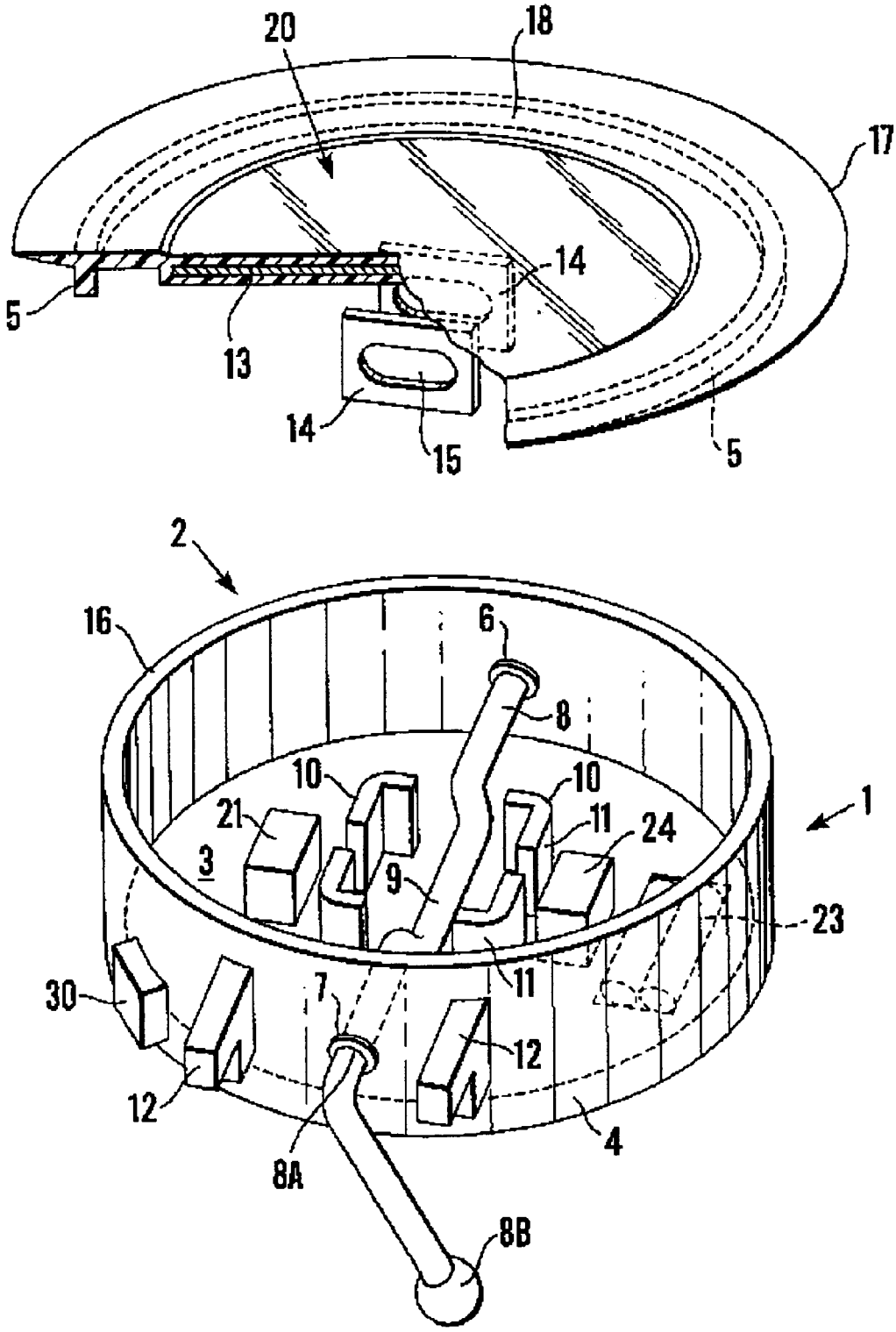

This invention relates to a means for indicating displacements of linearly and/or angularly displaceable objects, and/or for maintaining a predetermined setting of such objects relative to a reference location.

In particular, but not exclusively, the present invention is concerned with indicating the position of slidable members and/or tiltable members relative to a fixed position such as a framework in which the members are mounted for slidable or tiltable movement.

Many premises are provided with sliding type doors and windows. For example, large area sliding doors that are often referred to as patio doors. In the case of windows there are the well known sash types which are opened and closed by vertically sliding one part of the window unit relative to another part of the window unit. Window constructions are also known which are inclinable relative to the window frame whilst others are both bodily openable about a vertical axis and also titable about a horizontal axis.

A further form of window construction involving relatively slidable parts are those which include sections which are relatively displaceable in a horizontal direction.

Other forms of window construction are those which are tilted about a horizontal axis during the opening and closing operations.

As is well known, an important factor in relation to the security afforded by doors or windows is the ease by which a door or window can be opened without legitimate users of a property becoming aware that a window or door of the property is being displaced from its closed or from a previously set part open setting.

Security systems serving to detect when a window or door is subjected to unauthorized opening are known.

These known systems are not generally totally applicable in their application to doors and windows as presently used in many premises and may be presently already installed since they can be regarded as being restricted in their application by being able only to provide indication as to whether or not a door or window is open or closed.

Thus these known systems are not suitable for accommodating the degree/extent of or changes in the amount of opening of such doors and windows.

It is an object of the present invention to provide an improved security device in relation to the security afforded by doors and/or windows.

Broadly, according to a first aspect of the present invention there is provided a device for indicating/preventing displacement or for indicating/limiting the overall displacement of a movable member from a preset position, wherein the device is adapted to be selectively positionally mountable to the member.

Preferably, the device is adapted to enable predetermined variations in allowable displacement of a moveable member prior to preventing displacement of the member or for providing an indication of any such displacement of the member.

In accordance with a further aspect of the invention there is provide a device adapted for releasable attachment to the displaceable member, at such position as to be able to contact a non-movable region relative to which the movable member is displaceable following a predetermined amount of displacement, the device including means for producing an indication that such allowed amount of displacement has been effected.

In accordance with a further aspect of the invention there is provided a method of indicating/preventing displacement or for indicating/limiting the overall displacement of a movable member from a preset position including the step of positionally mounting to the member a device adapted to be selectively positionally mountable to the member, the device including means for producing an indication that an allowed amount of displacement has been effected.

In a preferred application of the device the displacement to which the device is responsive is a linear displacement.

In a further preferred application of the device the displacement to which the device responds comprises an angular displacement.

Conveniently, the same device is able to respond to both modes of displacement.

In a preferred arrangement the indication constitutes an audible and or visual warning signal.

Figure 2:
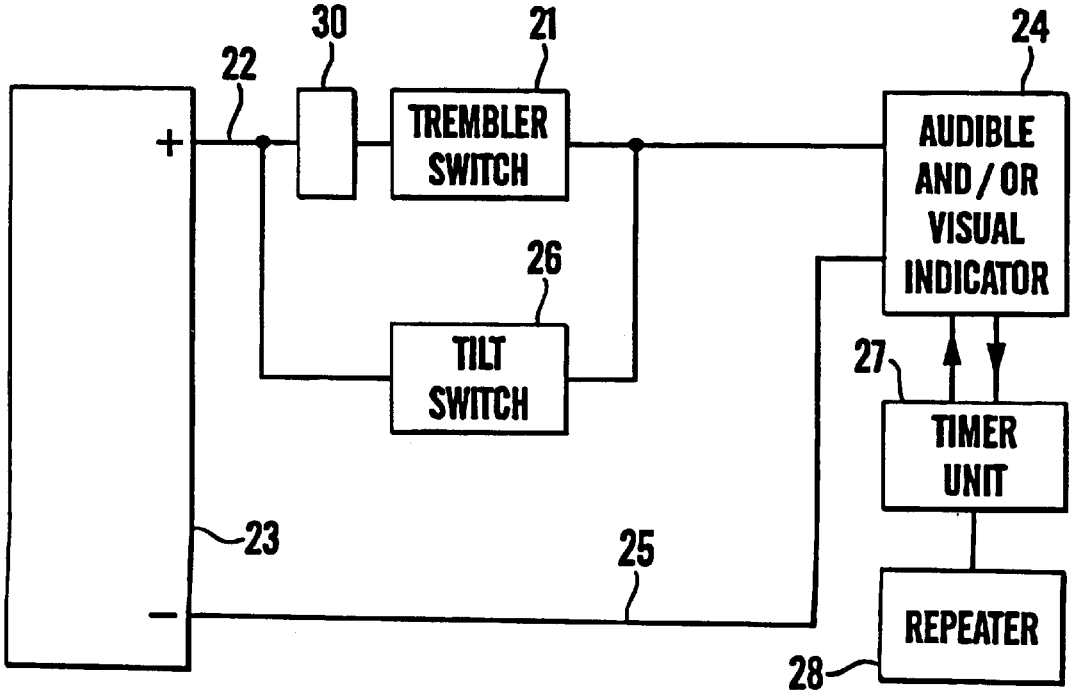
Figure 3:
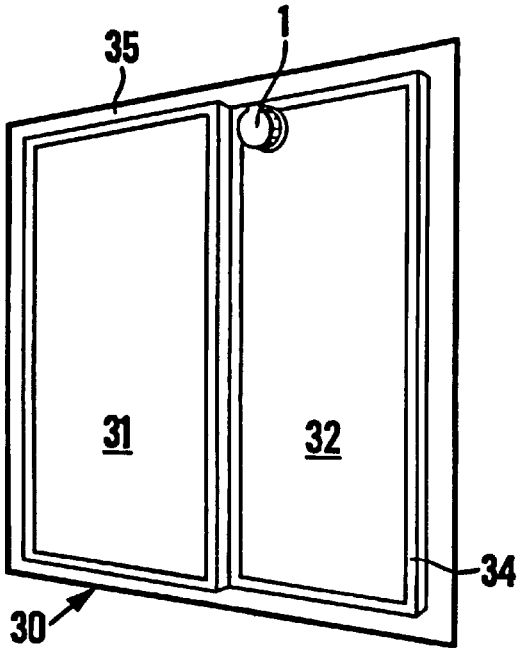
Figure 4:
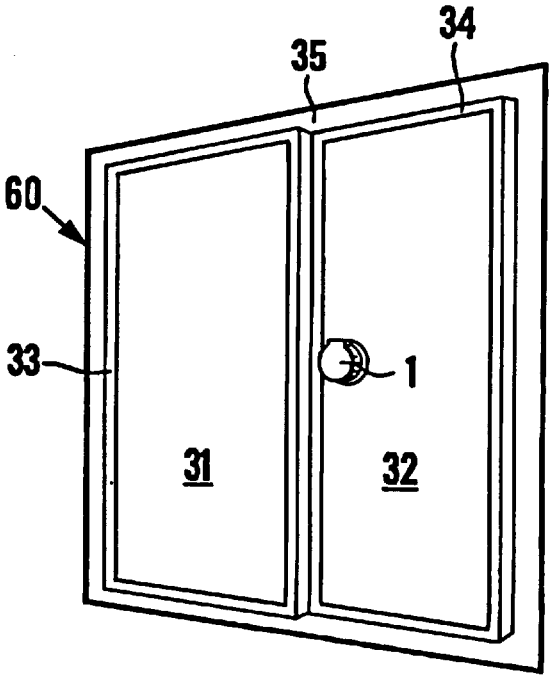
Figure 5:
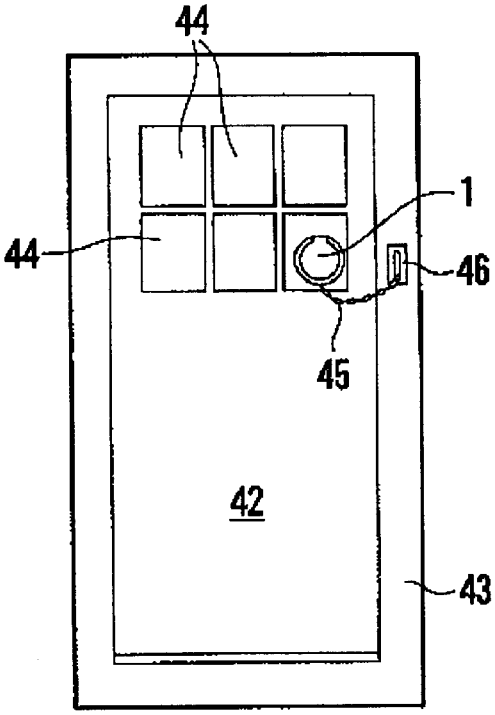
Figure 6:
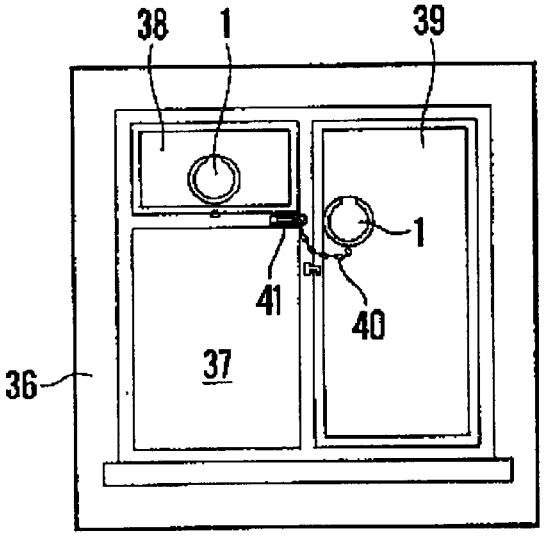
Figure 7:
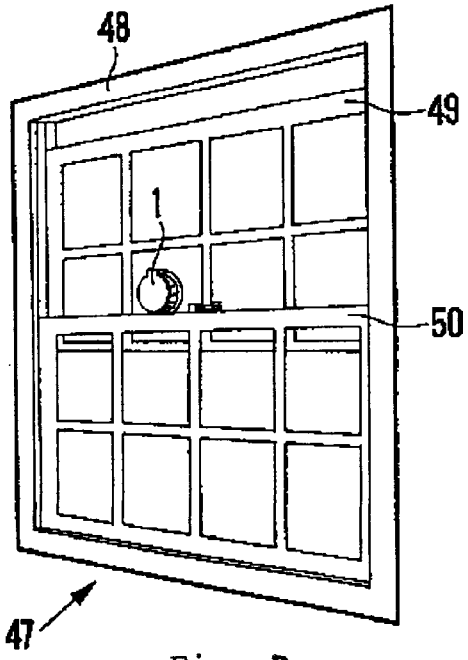
Figure 8:
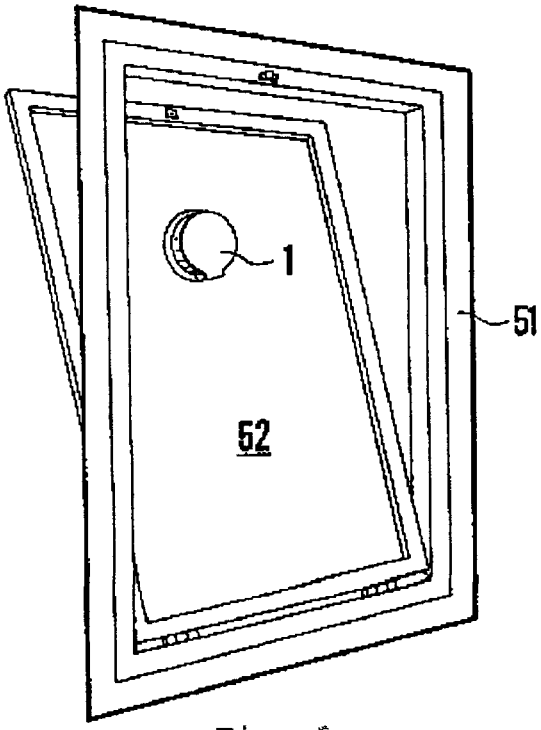

For a better understanding of the invention and to show how to carry the same into effect reference will now be made to the accompanying drawings in which:

FIG. 1 is a diagrammatic representation of a device incorporating the concepts of the invention, the device being shown both in part section and in exploded form;

FIG. 2, schematically illustrates in block digram form an electrical circuit for giving an indication of displacement;

FIGS. 3,4, and 5, respectively illustrate alternative modes of locating devices of the invention as applied to various forms of door;

FIG. 6, schematically illustrates the application of the device of the invention to a composite window assembly;

FIG. 7 schematically illustrates the application of the device of the invention to a tiltable window; and FIG. 8 schematically illustrates the application of the device of the invention to a window commonly known as a sash window.

Referring now to the drawings and more particularly to FIG. 1 in which a device 1 in accordance with the invention is schematically represented.

The device 1 comprises a housing 2 including a first end wall structure 3, a cylindrical wall 2, and a second end wall structure 5.

The cylindrical wall 2 is provided with diametrically opposite circular openings 6 and 7 which are intended to act as bearing surfaces for receiving and locating an operating element 8 that includes a crank 9 in such location that when the element 8 is engaged with the bearing surfaces 6 and 7 the crank 9 is centrally located relative to the diameter of the cylindrical wall 2. One end of the operating element 8 is held in place by a retaining nut (not shown) whilst the other end is provided with an Allan key fitting 8A whereby the element 8 can be rotated as required by a removable operating Allan key 8B.

Two wall formations 10 are located in the central region of the housing and are equidistantly spaced from the axis of rotation of the operating element 8. Each wall formation 10 comprises two L-shaped elements 11 arranged effectively to form the corners of a rectangle.

Two lug-like elements 12 project outwardly from the wall. These elements are intended to provide limit stops for limiting the extent of rotation of the key 8B and thus the rotation of the crank 9 within the housing 2.

In a modification the elements 12 are replaced by a regular U-formation flange part, the side arms of which part form the limit stops, with the U-formation serving as a means for generally protecting the Allan key fittings.

The end wall structure 5 comprises a circular metal plate 13 (shown in part section) having two upstanding lugs 14. In the FIG. 1 these are shown as being downwardly since they need to be directed towards the interior of the housing when the wall structure 5 is secured to the wall 2. Each such lug 14 is provided with an elongate aperture 15.

The dimensions of the lugs 14 and the location thereof on the plate 13 are such that when the end structure 5 is mounted to the wall 4 the lugs 14 engage between the wall formations 10 on the end structure 3. The crank 9 of the operating element 8 is engaged with the elongate apertures 15 during the mounting of the element 8 for rotation in bearing surfaces 6 and 7. It will be appreciated that during this engagement the element 8 will be suitably aligned to facilitate and to enable the threading of the element 8 through the lug apertures 15.

The metal plate is encapsulated in an elastomeric covering material which is shaped to provide the form of the end structure 5 which latter is resiliently engageable with the free annular end 16 of the wall 4 to provide a firm grip with the wall 4. In addition, the end structure 5 includes an outwardly extending peripheral annular part 17 which in conjunction with the remainder of the exposed outer surface of the structure 5 defines an overall surface 18 having a very smooth surface finish that effectively defines a suction/vacuum type sealing surface.

Thus, if the exposed surface 18 is placed against an adequately smooth surface such as the surface of a glass sheet (not shown) and the operating key 8B is engaged with the element 8 Allan key fitting 8A and is operated in such manner as to pull the lugs inwardly towards the structure 3, and thus the central region of the outer surface 18 inwards towards the remainder of the housing, a suction induced sealing effect is produced between the said exposed surface 18 and the glass sheet. The consequence of this suction effect is firmly to attach the device 1 as so far discussed to the glass sheet.

If the device 1 as so far discussed is mounted to the glass of a slidable door it will be appreciated that on sliding the door in its further opening direction the device 1 as so far described will be caused to abut or otherwise strike against the framing of the door. In view of the suction attachment of the device 1 to the slidable part of the door further movement movement is stopped.

This 'stopping' effect is utilised according to the invention to produce the audible and/or visual indication that the door has been so displaced.

In accordance with a particular embodiment of the invention apparatus responsive to the arresting of the door movement is housed within the housing 2.

FIG. 2 very schematically illustrates an electrical circuit by means of which the aforementioned indicating can be produced. As will be seen from FIG. 2 the electrical circuit includes a so called trembler switch 21 which remains in a quiescent switched-off condition so long as the door to which the device is attached is not subjected to motion arresting forces which would cause the trembler switch 21 to actuate to a switched-on condition.

The trembler switch 21 is electrically connected in the positive voltage line 22 from a power supply 23 to an audible sound emitting device 24. The negative line 25 of the power supply 23 is electrically connected to the sound emitting device 24 to complete an electrical circuit electrically controlled by the operational state of the trembler switch 21.

In addition to the provision of the trembler switch 21 a tilt responsive switch 26 is connected in parallel therewith whereby the device of the invention is responsive to any tilting of the surface to which the device of the invention is attached in excess of an angle defined by the tilt angle operation set into the tilt switch.

A timer unit 27 is provided for limiting the duration of operation of the unit 24. If desired, an indication repeater means 28 may be provided for causing the indicator to repeat its indication output from time to time until the device 1 has been monitored and reset.

A further switch 30 is provided to act as a switch for arming the electrical circuit as above discussed whereby the electrical circuit is caused to become operational when the operating key 8B is moved to the position in which the suction effect is produced to secure the device 1 of the invention to an appropriate surface whose position is to be monitored. This switch can be located internally or externally, with the internal location being preferred.

As will be appreciated the electrical circuit can be provided in the form of a printed ciruit board and if considered useful the various components can be encapsulated.

It will be understood that the housing provided for the electrical circuitry can be of a construction differing from that hereinbefore described since the main purpose of the housing is to provide accommodation for the electrical circuitry together with the provision of means for enabling the housing to be secured to a glass surface.

FIGS. 3 and 4 illustrate the mounting of devices 1 to a multi-door sliding door assembly 60 including doors 31 and 32 provided with associated frames 33 and 34 slidably mounted in slide guides (not specifically shown) of a main door frame 35 provided in a wall (not shown) and providing the slide guides for the doors 31 and 32.

In FIG. 3 the device 1 is shown to be positioned close to the upper rail of the frame 34.

In FIG. 4 the device 1 is located in the region of the conventional level for a normally provided door operating means (now shown).

By locating the device in the positions shown relative movement of the doors 31 and 32 is prevented. It will be appreciated that if the devices 1 were to be located at a locations to the right of those shown in the Figure the doors would be capable of limited relative movement.

A further advantage arising from mounting the device close to the upper rail of the slidable door frame 34 as shown in FIG. 3 is that any attempt to lift the sliding door 32 upwardly from its guides in the frame 35 is prevented, since any such attempt causes operation of the trembler switch 21.

FIG. 6 schematically illustrates a composite window structure as commonly provided in residential properties. As can be seen the structure includes a main framework 36 set into a wall for mounting a fixed sheet of glass 37, a tiltable window 38 and a pivoted swing window 39.

FIG. 6 also schematically illustrates the application of the device 1 to tilt type window 38 for the providing indication of any displacement of the window 38 from a preset position. In addition, the Figure illustrates the use of the device 1 in conjunction with a locking chain 40, which connects with a conventional slide catch 41 provided on the frame 36. This arrangement provides a means whereby the extent of the opening of the window 39 can be controlled.

FIG. 5 schematically illustrates a door 42 and its associated framework 43 mounted to a wall (not shown), the door incorporating a number of separate pieces of flat glass 44. In the FIG. 5 device 1 is shown mounted to one of the sheets of glass and connected by way of a conventional door opening limitation chain 45 that couples with a positionally fixed slide catch 46.

In practice, the provisions of the chains 40,45 and their associated catches 41 and 46, has the result that if anyone attempts to force the door, the resulting interaction between the devices 1 and the associated chains 40,45 causes the trembler switch 21 to be set into operation.

Referring now to FIG. 7, this Figure schematically illustrates in conventional sash type window 47 including a main frame 48, and upper to and lower slidable sashes 49 and 50. As shown a device 1 according to the invention is attached to one of the panes of glass of the upper sash at a location at the lower region of the upper sash. With this arrangement the extent of allowable relative displacement of the sashes 49 and 50 can be selectively set.

FIG. 8 illustrates a tiltable window construction including a main frame 51 and a tiltable window 52 pivotally mounted to the lower part of the frame 51.

By mounting a device 1 according to the invention any departures from an allowable degree of tilt can be monitored by reason of the tilt switch 26 provided in the device.

What is claimed is:

1. A device for attachment to a smooth surface and including at least one sensor, the device comprising: a housing including a flexible end wall having an outer perimeter for engaging the smooth surface, a second end wall spaced from the flexible end wall, a side wall connecting the flexible end wall to the second end wall and surrounding any space between the flexible and second end walls, two openings in the side wall, an operating element including a crank received for rotation in the two openings, a lug fixed to the flexible end wall and projecting into the space between the flexible and second end walls, and an aperture in the lug engaging the crank so that rotation of the operating element causes displacement of a central portion of the flexible end wall for defining a suction between the flexible end wall and the smooth surface sufficient to support the device on the smooth surface.

2. The device of claim 1 further comprising a key engaging one end of the operating element to permit rotation of the operating element relative to the side wall for causing displacement of the flexible end wall.

3. The device of either claim 1 or 2 further comprising at least one stop fixed to the side wall for limiting the range of rotation of the operating element.

4. The device of claim 3 wherein said at least one sensor comprises a displacement sensor and an indicator coupled to the displacement sensor of indicating the sensing of movement.

5. The device of claim 4 further comprising a timer coupled to the indicator for limiting any duration of operation of the indicator.

6. The device of claim 5 further comprising a repeater coupled to the timer for periodically renewing any indication of sensed movement until manually reset.

7. The device of either claim 1 or 2 wherein the aperture in the lug engaging the crank on the operating element comprises an slot elongated along a line generally parallel to the surface of the flexible end wall.

8. A device for attachment to a smooth surface and including at least one displacement sensor and an indicator coupled to the displacement sensor of indicating the sensing of movement, the device comprising: a housing including a flexible end wall having an outer perimeter for engaging the smooth surface, a second end wall spaced from the flexible end wall, a side wall connecting the flexible end wall to the second end wall and surrounding any space between the flexible and second end walls, two openings in the side wall, an operating element including a crank received for rotation in the two openings, a lug fixed to the flexible end wall and projecting into the space between the flexible and second end walls, and an elongated aperture in the lug engaging the crank so that rotation of the operating element causes displacement of a central portion of the flexible end wall for defining a suction between the flexible end wall and the smooth surface sufficient to support the device on the smooth surface.

9. The device of claim 8 further comprising at least one stop fixed to the side wall for limiting the range of rotation of the operating element.

10. The device of either claim 8 or 9 further comprising a key engaging one end of the operating element to permit rotation of the operating element relative to the side wall for causing displacement of the flexible end wall.

11. The device of either claim 8 or 9 further comprising a timer coupled to the indicator for limiting any duration of operation of the indicator.

12. The device of claim 11 further comprising a repeater coupled to the timer for periodically renewing any indication of sensed movement until manually reset.

13. A device for attachment to a smooth surface and including at least one displacement sensor, the device comprising: a housing including a flexible end wall having an outer perimeter for engaging the smooth surface, a second end wall spaced from the flexible end wall, a side wall connecting the flexible end wall to the second end wall and surrounding any space between the flexible and second end walls, two openings in the side wall, an operating element including a crank received for rotation in the two openings, a set of lugs fixed to the flexible end wall and projecting into the space between the flexible and second end walls, elongated apertures in the lugs engaging the crank so that rotation of the operating element causes displacement of a central portion of the flexible end wall for defining a suction between the flexible end wall and the smooth surface sufficient to support the device on the smooth surface, a key engaging one end of the operating element to permit rotation of the operating element relative to the side wall for causing displacement of the flexible end wall, and at least one stop fixed to the side wall for limiting the range of movement of the key during rotation of the operating element.

14. The device of claim 13 further comprising an indicator coupled to the displacement sensor of indicating the sensing of movement.

15. The device of claim 14 wherein the displacement sensor comprises an electronic circuit including means responsive to at least one of linear and angular displacements of the device for sending a signal to the indicator.

16. The device of claim 15 further comprising a timer unit for enabling selective control over the duration of operation of electronic circuit in producing said indication.

17. The device of claim 16 further comprising operation repeater means causing the device to repeat any indication from time to time until the device has been reset.

* * * * *